United States Patent [19]

Laubach

[11] 4,028,513

[45] June 7, 1977

[54] STEEL ARCING CONTACT FOR CIRCUIT BREAKER

[75] Inventor: Ward E. Laubach, Cherry Hill, N.J.

[73] Assignee: I-T-E Imperial Corporation, Spring House, Pa.

[22] Filed: May 8, 1975

[21] Appl. No.: 575,717

[52] U.S. Cl. ..... 200/144 R; 200/146 R; 200/263

[51] Int. Cl.[2] ..... H01H 33/12

[58] Field of Search ..... 200/144 R, 146 R, 239, 200/244, 245, 250, 263, 266, 290

[56] References Cited

UNITED STATES PATENTS

| | | | |
|---|---|---|---|
| 2,031,516 | 2/1936 | Tritle | 200/146 R |
| 2,253,672 | 8/1941 | Walter | 200/263 |
| 2,318,086 | 5/1943 | Lindstrom | 200/146 R |
| 2,365,249 | 12/1944 | Comstock | 200/263 |
| 3,889,082 | 6/1975 | McFarland | 200/144 R |

*Primary Examiner*—Gerald P. Tolin
*Attorney, Agent, or Firm*—Ostrolenk, Faber, Gerb & Soffen

[57] ABSTRACT

The arcing contact of a circuit breaker is made of a steel body which is plated with a copper flash and is then silver-plated. An arcing contact tip which makes actual contact to a cooperating arcing contact is made of a conventional silver-molybdenum alloy which is attached to the steel arcing contact as by brazing. The steel arcing contact is then connected in parallel with a conventional main contact which is made of high conductivity copper, or some other material having a conductivity which is high in comparison to the conductivity of steel. The steel arcing contact is used in either a butt-type contact configuration or in a jaw-type contact configuration.

7 Claims, 4 Drawing Figures

FIG. 1.
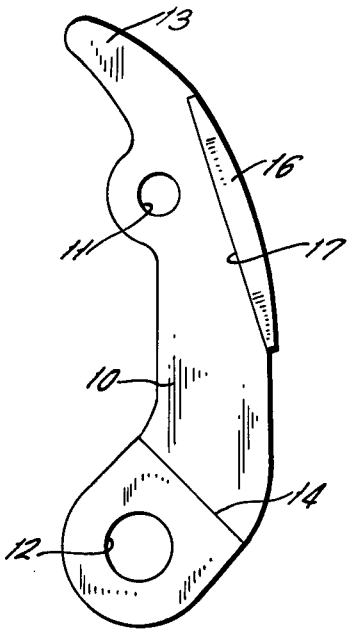
FIG. 2.
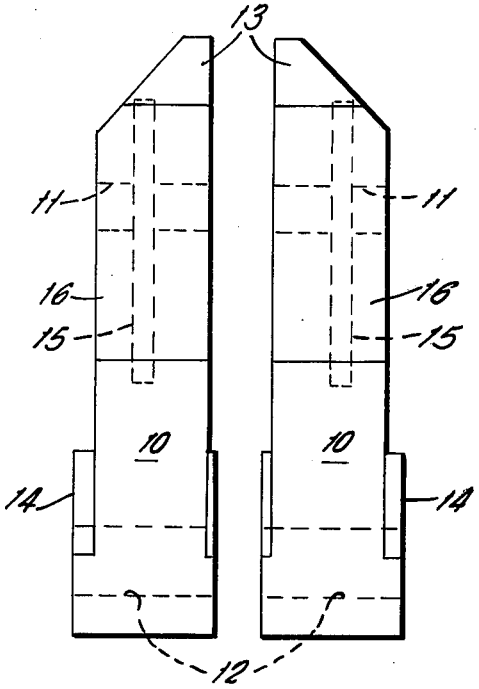
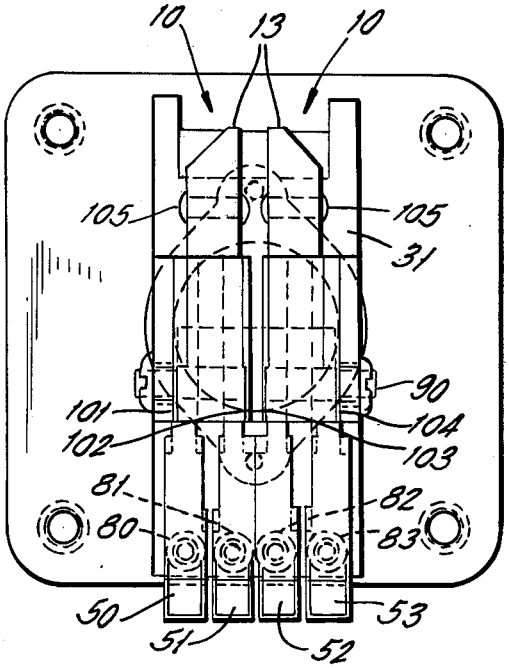
FIG. 4.

35
43
102
13
110
111
105
11
12
16
10
90
12
41a
41b
40
41
70
86
51
50
85
80
31
34
89
88
40a
30
32
33
23
25
24
22
21
20

STEEL ARCING CONTACT FOR CIRCUIT BREAKER

BACKGROUND OF THE INVENTION

This invention relates to a novel contact construction for a circuit breaker wherein a pair of main contacts of relatively high conductivity are arranged in parallel with arcing contacts which have a steel body of relatively low conductivity.

Circuit breaker contact configurations are well known to those skilled in the art. For example, an air-magnetic breaker which may have a voltage rating of above 1,000 to about 20,000 volts and a continuous current rating in excess of 1,000 amperes will conventionally have a movable contact which carries a main contact which makes low resistance connection to a cooperating relatively stationary main contact and will also have a movable arcing contact which makes connection with a cooperating arcing contact on the relatively stationary body. The arcing and main contact sections are electrically connected in parallel with one another.

The contacts are then arranged in such a manner that, when opening the contacts, the main contacts will open first so that the current through the main contacts will commutate into the parallel-connected arcing contacts, and the arcing contacts are thereafter opened, with all arcing duty being handled by the arcing contacts. By using this configuration, the main contacts are kept relatively smooth and unpitted and unaffected by arcing problems so that a good low resistance connection can be maintained between the main contacts even after numerous operations. Moreover, this permits the main contacts to be made of materials best adapted for normal low resistance connection to one another without concern for ability to withstand high arcing temperatures or high mechanical strength.

The arcing contacts on the other hand are selected to be of material which is highly resistant to deterioration due to arcing and arcing products with relatively little concern for contact resistance, since they can have a relatively high contact resistance while still allowing the commutation of current into the arcing contacts after the main contacts have opened.

The arcing contacts of air-magnetic circuit breakers have traditionally been made of a non-ferrous high conductivity high mechanical strength. For example, to provide the thermal capacity and mechanical strength which was thought necessary for the arching contacts, the material usually used has been a copper alloy such as beryllium-copper or at least silver-bearing copper which has high resistance silver molybdenum arcing contact tips brazed to the beryllium-copper body. As previously noted, since the arcing contacts will be connected in a parallel with high conductivity main contacts, the continuous current capacity of the arcing contacts is relatively unimportant and the relatively high resistance materials are used because they have the desired thermal and mechanical characteristics.

The materials which have traditionally been used for arcing contact bodies, such as a beryllium-copper alloy, is relatively expensive and is relatively dificult to machine and otherwise process. Circuit breaker manufacturers, however, have traditionally continued to use relatively expensive beryllium-copper alloys for the arcing contact bodies since, in part, it was believed necessary to use a non-ferrous material so as not to interfere with the movement of the arc between the arcing contacts.

BRIEF SUMMARY OF THE INVENTION

In accordance with the present invention, it has been discovered that the arcing contact body can be made of a ferrous material without interference with the operation of the arcing contacts. By way of example, arcing contacts made of a relatively inexpensive carbon steel have been fabricated and have been shown to operate successfully as the arcing contact of an air-magnetic circuit breaker, which contact is connected in parallel with conventional low resistance main contacts. Thus, it was discovered that inexpensive ferrous materials do not have such a high resistivity that they interfere in any way with the operation of the circuit breaker contacts and, moreover, that the use of the ferrous material in the vicinity of the arc does not interfere with the positioning or control of the arc drawn between separating contacts, and the commutation of the current from the main contacts into the arcing contacts during circuit interruption.

The use of cabon steel for the arcing contacts was selected because the material is relatively inexpensive and is easily machined. Other steels, however, can be used such as stainless steel (which eliminates all possible magnetic problems), or the like. Carbon steel, however, such as C1018 has been preferable since it is inexpensive and its resistivity is relatively low as compared, for example, to stainless steel type 302.

When using a ferrous arcing contact, such as carbon steel or stainless steel, the contact is first fabricated to its desired shape. A conventional arcing tip, such as one of a silver-molybdenum alloy, is then brazed to the steel arcing contact. The use of carbon steels for the arcing contact body may be preferred to stainless steel since it is easier to braze the silver-molybdenum alloy arcing contact tip to the steel arcing contact body. The assembly is then plated with a copper flash and is plated with silver. The silver-plating operation is the same operation that is conventionally used with a beryllium-copper arcing contact body. Silver plating is then removed from the alloy arcing tip surface.

As will be understood hereinafter, the novel steel arcing contact can be used in parallel with a main contact arrangement in virtually any type of contact configuration. Thus, it can be used in connection with a butt-type contact arrangement or with a jaw-type contact arrangement. It is further noted that, where the steel arcing body is pivotally mounted, so that spring pressure can be applied to the body in order to provide a relatively high contact pressure when the contacts are closed, a relatively low resistance connection can be made through the pivot of the steel arcing contact to the main terminal which pivotally supports the contact through the use of conductive washers and the like in the standard prior art manner. That is to say, the use of silver-plated steel for the arcing contact body does not produce an excessively high resistance at the pivotal joint which receives the silver-plated steel arcing contact and the contact resistance produced does not interfere with commutation of current from the main contacts into the arcing contacts after the main contacts are opened.

BRIEF DESCRIPTION OF THE DRAWINGS

FIG. 1 is a plan view of an arcing contact which may be constructed in accordance with the present invention.

FIG. 2 is a front view of two spaced arcing contacts of the type shown in FIG. 1 and positioned relative to one another in the positions they will occupy in a circuit breaker.

FIG. 4 is a front view of the arcing contact and main contact configuration of FIG. 3 with the movable contact assembly removed.

DETAILED DESCRIPTION OF THE DRAWINGS

Figure 3:
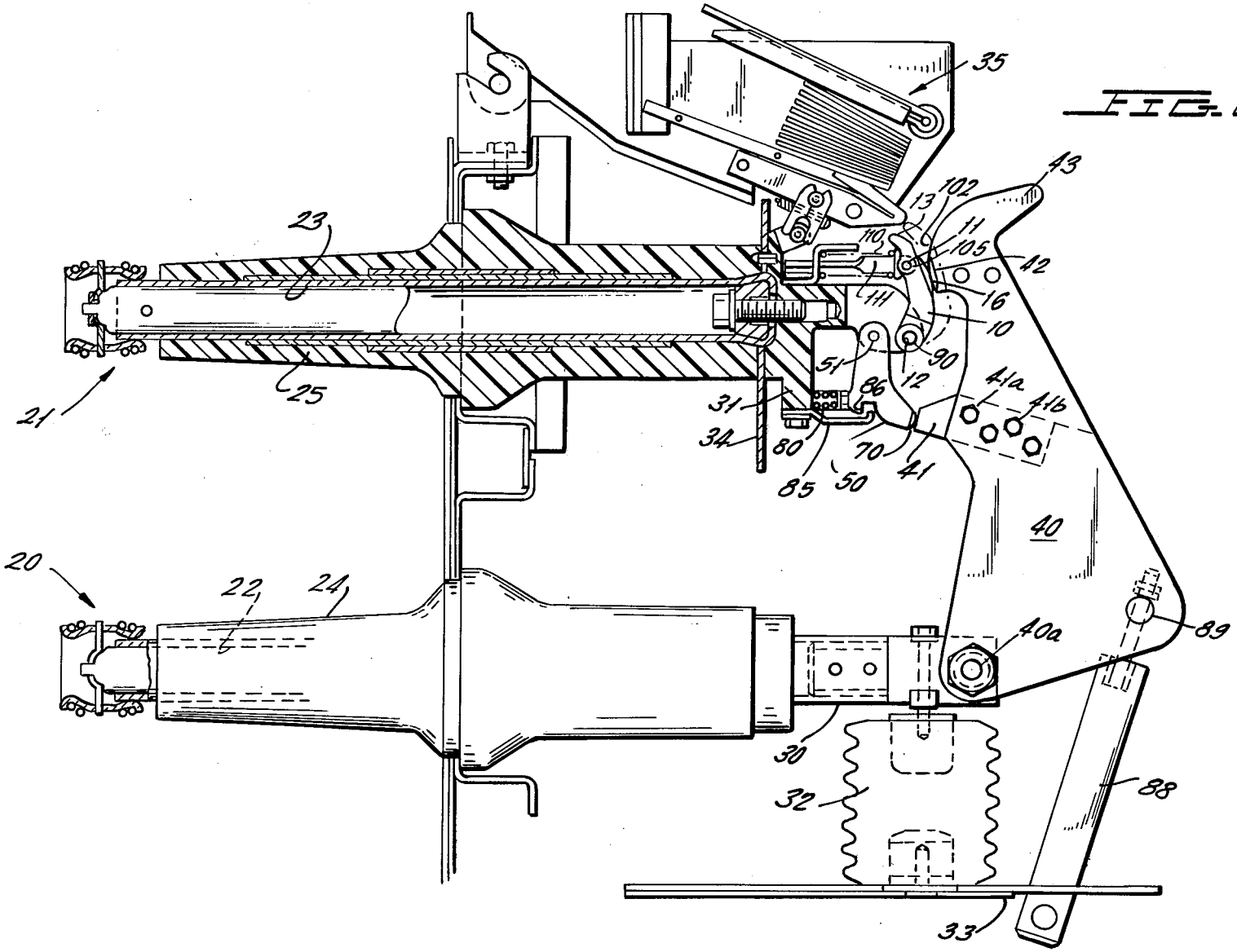
FIG. 3 is a side view partly in cross-section of the current carrying parts of one pole of a circuit breaker which uses the novel steel arcing contact of the invention.

Referring first to FIGS. 1 and 2, there is shown therein a typical form for a butt-type arcing contact constructed in accordance with the invention which is used in parallel with a main contact as will be shown in connection with FIGS. 3 and 4.

Referring to FIG. 1, the arcing contact consists of a body 10 of a carbon steel such as carbon steel type 1018 or the like which has been suitably fabricated and which has pivot pin receiving openings 11 and 12 therein used in connection with the mounting of a contact. As shown in FIG. 2, the two arcing contacts 10 are used in conjunction with one another as a left-hand and right-hand set, respectively, and each have arcing horn extensions 13 and mounting shoulders 14. It is to be noted that the physical configuration of the arcing contact assembly shown in FIGS. 1 and 2 is identical to the physical configuration of a prior art type of arcing contact assembly which, however, was previously made of a beryllium-copper body.

A central arcuate slot 15 is also formed in the body of the device and through the pivot opening 11 as shown. The arcing contact tip which is the body which actually makes contact to a cooperating arcing is then formed by an arcing tip insert 16 which is brazed to a flat 17 on the steel body 10. The contact tip 16 is brazed in place on body 10 by conventional brazing techniques. After arcing contact tip 16 is brazed to the carbon steel body 10, the carbon steel body 10 and tip 16 is coated with a copper flash and is thereafter silver-plated in the conventional manner for the silver-plating of the prior art beryllium-copper body. The silver plate is then removed from the surface of the arcing contact tip 16.

In the prior art use of the beryllium-copper alloy, a heat treatment was traditionally applied after the brazing step. It has been found that heat treatment of the steel body 10 is not needed after the brazing operation.

The completely subassembled arcing contact of FIGS. 1 and 2 may now be used in any conventional circuit breaker, it having been discovered that the resistance presented by the silver-plated carbon steel body between the contact tip 16 and the pivot opening 12 at which current is transferred to some high conductivity structure is sufficiently low to allow the commutation of current from a parallel-connected main contact into the arcing contact during circuit opening.

The manner in which the arcing contact may be assembled as a butt-type arcing contact in a conventional circuit breaker is shown in FIGS. 3 and 4 which show the current carrying parts of a conventional 15 HK 1000, 1200 ampere circuit breaker. Circuit breakers of the type shown in FIGS. 3 and 4 are old as well known wherein the arcing contacts have used beryllium-copper bodies and are modified in accordance with the present invention by the use of a ferrous material for the arcing contact body as shown in FIGS. 1 and 2.

Referring now to FIGS. 3 and 4, the arcing contact assemblies 10 of FIGS. 1 and 2 are shown and cooperate with the other components as will be described. The main current carrying parts of the circuit breaker shown, which is a standard 15 HK 1000 circuit breaker which has been manufactured and sold by the I-T-E Imperial Corporation, the assignee of the present invention, contains two disconnect contact assemblies 20 and 21 which are adapted to make connection to the stationary disconnect contacts of some suitable switchgear housing for the circuit breaker (not shown). The disconnect contacts 20 and 21 are carried at the ends of tubular conductors 22 and 23, respectively, which are contained in suitable epoxy-type housings 24 and 25, respectively. Tubular conductors 22 and 23 are terminated by stationary conductive terminals 30 and 31, respectively. Stationary terminal 30 is suitably supported by a support insulator which is secured to the circuit breaker support frame member 33 while the stationary terminal 31 is supported as from the circuit breaker support frame member 34. Terminals 30 and 31 are made of high conductivity copper.

A suitable arc chute arrangement 35 is provided above the contact region to be described which includes the novel steel arcing contact assembly 10 which was previously described. The lower contact terminal 30 then pivotally receives movable contact arm 40 at the conductive pivot region 40*a*. The movable contact arm 40 then carries a main movable contact 41, which is bolted thereto as by bolts 41*a* and 41*b*, and an upper arcing contact 42 which is suitably fixed as by brazing or bolting to the contact arm 40 and which smoothly extends into the rearwardly extending arcing horn 43.

It should be noted that the entire contact arm 40 will be made of the very low resistivity copper and that the main contact 41 may be of silver or the like to produce an absolute minimum contact resistance when it engages its cooperating main contact to be described hereinafter. Contact insert 42, however, is of a material adapted to resist erosion due to arcing and can, for example, be of a silver-molynbdenum alloy.

The contact support 31 then pivotally supports main contact members, such as contact members 50, 51, 52 and 53 on the pivot 51. A plurality of conductive spring washers which may be silver-plated washers are interposed between the connection between comb-type elements of support member 31 and the contact elements 50, 51, 52 and 53 to form a good relatively low resistance current carrying path from the individual contacts 50 to 53 to the main current terminal 31. Note further that the main contacts 50 to 53 cooperate with identical individual contacts such as contact 41 in the assembled device. Each of main contacts 50 to 53 are terminated with the lowest possible resistivity material such as silver contact member 70 for contact 50 in FIG. 3, thereby to ensure the lowest possible contact resistance for the main pair of contacts.

Each of the individual pivotally mounted contacts 50 to 53 are then further provided with biasing springs, such as springs 80 to 83, respectively, which tend to press the main contacts 50 to 53 into high pressure contact with their respective cooperating contacts such as contact 41. A stop member 85, shown in FIG. 3, extends from the support 31 and stops beneath a notch such as the notch 86 in contact finger 50 (and a similar notch in fingers 51 to 53) to limit the movement of the contacts 50 to 53 after the movable contact 40 has rotated around its pivot 40*a* to an open position. Note that the contact arm 40 is operated by a suitable operating mechanism (not shown) which is connected to the operating rod 88 which is, in turn, pivotally connected at pivot 89 to the contact arm 40. The downward movement of shaft 88 will clearly cause the arm 40 to rotate about pivot 40*a*, moving contact arm 40 toward an open position.

The two steel arcing contact assemblies 10 are then pivotally mounted onto an extension of terminal member 31 by the pivot pin 90 shown in FIGS. 3 and 4. The two arcing contact assemblies 10 have the relative positions shown in FIGS. 2 and 4.

Suitable conductive washers, such as conductive washers 101, 102, 103 and 104 are interposed between the sides of arcing contacts 10 surrounding pivot openings 12 and provide a low resistance pivotal connection from the arcing contact bodies 10 into the current shape fingers of terminal member 31 which receives the arcing contacts 10. The washers 101 to 104 may be standard silver-plated washers which have been conventionally used in circuit breakers of the type shown in FIGS. 3 and 4.

A spring biasing mechansim including spring 110 which is secured relative to terminal 31 has a central member 111 best shown in FIG. 3 which presses on pins, such as pins 102 in pivot openings 11 (FIGS. 1 and 2), thereby tending to rotate the arcing contact assemblies 10 clockwise around pivot 90 in FIG. 3. A suitable stop mechanism is provided to prevent the rotation of the arcing contacts 10 beyond the dotted-line position shown in FIG. 3. The spring 110 then provides the necessary pressure for making a relatively high pressure contact between the contact members 16 and 42 of the cooperating arcing contacts.

In operation, when the circuit breaker is closed, the arm 40 is in the position shown and high pressure contact is made between the parallel-connected main contacts 50 to 53 and 41 and the cooperating arcing contacts 10 and 42. The connection between main contacts 50 to 53 and cooperating contact 41 is a much lower resistance connection so that most current flows through this relatively low resistance point.

In order to open the breaker, contact arm 40 is rotated clockwise about pivot 40*a*. In the initial part of the movement of arm 40, main contacts 50 to 53 follow contact 41 by rotating about their pivot 51 until the stop position defined by stop member 85 is reached. At this point the contacts 50 to 53 separate from the contacts 41. The arcing contacts 10, however, are arranged so that they continue to pivot about the pivot point 90 and to engage cooperating arcing contact 42 until after the main contacts have separated. Thus, the current flowing through the circuit breaker commutates into the relatively high resistance connection between the arcing contacts, since this resistance is not sufficiently high to prevent commutation. When the dotted-line position of FIG. 3 is reached by the arcing contacts 10, they separate and an arc is now drawn between the cooperating arcing contacts 10-42. This arc is conventionally treated and is moved into the arcing chamber (not shown) via jump gap 35 where the arc is elongated and cooled and is ultimately interrupted.

In experiments which have been performed, it has been found that the use of a ferrous material such as a carbon steel for the body of arcing contacts 10 does not insert a high enough resistance to prevent commutation of current into the arcing contacts and, moreover, that the presence of the ferrous material does not adversely affect the interruption of current at the arcing contacts. Moreover, the use of a ferrous material for the arcing contact is substantially less expensive than the use of a beryllium-copper material and lends itself to simpler fabrication techniques.

In FIGS. 1 to 4 the invention has been described for use in connection with butt-type contacts. It will be apparent to those skilled in the art that the invention can also be applied to in any contact configuration wherein arcing contacts are placed in parallel with the main contacts and, for example, would have application to a jaw-type contact arrangement having separate arcing and main contact paths.

Although this invention has been described with respect to its preferred embodiments, it should be understood that many variations and modifications will now be obvious to those skilled in the art, and it is preferred, therefore, that the scope of the invention be limited not by the specific disclosure herein, but only by the appended claims.

The embodiments of the invention in which an exculsive privilege or property is claimed are defined as follows:

1. In a high power circuit breaker; a first stationary main terminal and second stationary main terminal, first and second main contacts movable between an engaged and disengaged position relative to one another and connected to said first and second main terminals, respectively, first and second arcing contacts electrically connected to said first and second main contacts, respectively, and to said first and second main stationary terminals, respectively, and movable between an engaged and disengaged position; said first and second arcing contacts being engaged before and disengaged after said first and second main contacts are engaged and disengaged, respectively; said first main contact having a major body portion of highly conductive metal; said first arcing contact having a major body portion consisting of a ferrous material and having a resistivity which is greater than the resistivity of said major body portion of said first main contact; said first arcing contact having a contacting tip portion for making engagement to said second arcing contact which is of an alloy of copper which has a greater resistance to erosion under the influence of an electric arc than either the said highly conductive metal material of said first contact or said ferrous material.

2. The apparatus of claim 1 wherein said ferrous material is carbon steel.

3. The apparatus of claim 1 wherein said major body portion of said first arcing contact has a copper flash coating thereon, and has a silver plating over said copper flash coating.

4. The apparatus of claim 2 wherein said highly conductive metal forming major body portion of said first main contact is copper.

5. The apparatus of claim 3 wherein said first arcing contact is pivotally mounted on said first main terminal and is biased to rotate toward high pressure contact engagement with said second arcing contact; and conductive washer means slidably pressed between said first arcing contact and said first main terminal for conducting current from said first main terminal to said first arcing contact.

6. The apparatus of claim 3 wherein said ferrous material is carbon steel.

7. The apparatus of claim 5 wherein said ferrous material is carbon steel.

* * * * *